US012251752B2

(12) United States Patent
Baranzke et al.

(10) Patent No.: US 12,251,752 B2
(45) Date of Patent: Mar. 18, 2025

(54) DEVICE AND METHOD FOR REMOVING AT LEAST ONE COOLING ELEMENT FROM AN AT LEAST PARTIALLY DEMOULDED CAST PART, METHOD FOR INTRODUCING AT LEAST ONE COOLING ELEMENT INTO A MOULD CORE OF A CAST PART MOULD

(71) Applicant: Nemak, S.A.B. de C.V., Garcia (MX)

(72) Inventors: Matthias Baranzke, Rehlingen-Siersburg (DE); Jochen Wilhelm, Nohfelden (DE); Gerald Klaus, Saarbruecken (DE); Thomas Weiser, St. Ingbert (DE); Dirk Schnubel, Saarbruecken (DE)

(73) Assignee: Nemak, S.A.B. de C.V., Garcia (MX)

( * ) Notice: Subject to any disclaimer, the term of this patent is extended or adjusted under 35 U.S.C. 154(b) by 405 days.

(21) Appl. No.: 17/605,642

(22) PCT Filed: Apr. 23, 2020

(86) PCT No.: PCT/IB2020/053845
§ 371 (c)(1),
(2) Date: Oct. 22, 2021

(87) PCT Pub. No.: WO2020/217199
PCT Pub. Date: Oct. 29, 2020

(65) Prior Publication Data

US 2022/0203434 A1 Jun. 30, 2022

(30) Foreign Application Priority Data

Apr. 24, 2019 (DE) ..... 10 2019 110 580.3

(51) Int. Cl.
*B22D 15/04* (2006.01)
*B22C 9/22* (2006.01)
*B22D 27/04* (2006.01)

(52) U.S. Cl.
CPC ..... *B22D 15/04* (2013.01); *B22C 9/22* (2013.01); *B22D 27/04* (2013.01)

(58) Field of Classification Search
None
See application file for complete search history.

(56) References Cited

U.S. PATENT DOCUMENTS 4,238,248 A 12/1980 Gyongyos et al.
5,038,707 A 8/1991 Swain et al.
(Continued)

FOREIGN PATENT DOCUMENTS

CN 1134327 A 10/1996
CN 1972770 A 5/2007
(Continued)

*Primary Examiner* — Daniel J. Schleis
(74) *Attorney, Agent, or Firm* — The Webb Law Firm

(57) ABSTRACT

The invention relates to a device for removing at least one cooling element from an at least partially demoulded cast part, in particular from a cast housing for an electric motor formed from a light metal alloy, which has an apparatus for removing the at least one cooling element. Furthermore, the invention relates to a method for removing at least one cooling element from an at least partially demoulded cast part, a method for introducing at least one cooling element into a mould core of a cast part mould, a cooling element, and a cast part.

19 Claims, 9 Drawing Sheets

(56) References Cited

U.S. PATENT DOCUMENTS

| | | | | |
|---|---|---|---|---|
| 5,673,743 | A | 10/1997 | Kawamoto et al. | |
| 5,730,200 | A | 3/1998 | Landua | |
| 6,059,902 | A | 5/2000 | Yoshihara et al. | |
| 6,343,641 | B1 | 2/2002 | Gigliotti, Jr. et al. | |
| 7,740,049 | B2 | 6/2010 | Sakurai et al. | |
| 9,718,124 | B2 | 8/2017 | Urhahn et al. | |
| 10,384,261 | B2 | 8/2019 | Stuhldreier et al. | |
| 2006/0042774 | A1 | 3/2006 | Newcomb et al. | |
| 2009/0165983 | A1 | 7/2009 | Lellig et al. | |
| 2010/0139884 | A1 | 6/2010 | Kube et al. | |
| 2014/0319956 | A1* | 10/2014 | Wang | B22D 21/007 164/57.1 |
| 2016/0016226 | A1 | 1/2016 | Aspacher et al. | |

FOREIGN PATENT DOCUMENTS

| | | | |
|---|---|---|---|
| CN | 102672112 | A | 9/2012 |
| CN | 202490914 | U | 10/2012 |
| CN | 207255172 | U | 4/2018 |
| CN | 109434027 | A | 3/2019 |
| CN | 109663860 | A | 4/2019 |
| DE | 2901028 | A1 | 2/1980 |
| DE | 4322181 | A1 | 1/1995 |
| DE | 19727096 | A1 | 1/1998 |
| DE | 19816163 | A1 | 10/1999 |
| DE | 60017523 | T2 | 12/2005 |
| DE | 102006006132 | A1 | 8/2007 |
| DE | 102006053404 | A1 | 5/2008 |
| DE | 102008019200 | A1 | 10/2009 |
| DE | 102014101080 | B3 | 7/2015 |
| DE | 102017216645 | A1 | 3/2019 |
| EP | 1981667 | B1 | 10/2008 |
| IN | 108856651 | A | 11/2018 |
| JP | H429153 | A | 1/1992 |
| JP | H524132 | A | 2/1993 |
| JP | H588740 | U | 12/1993 |
| JP | H6284622 | A | 10/1994 |
| KR | 1020110020367 | A | 3/2011 |
| WO | 2012079752 | A2 | 6/2012 |

* cited by examiner

DEVICE AND METHOD FOR REMOVING AT LEAST ONE COOLING ELEMENT FROM AN AT LEAST PARTIALLY DEMOULDED CAST PART, METHOD FOR INTRODUCING AT LEAST ONE COOLING ELEMENT INTO A MOULD CORE OF A CAST PART MOULD

CROSS-REFERENCE TO RELATED APPLICATIONS

This application is the United States national phase of International Application No. PCT/IB2020/053845 filed Apr. 23, 2020, and claims priority to German Patent Application No. 10 2019 110 580.3 filed Apr. 24, 2019, the disclosures of which are hereby incorporated by reference in their entirety.

BACKGROUND OF THE INVENTION

Field of the Invention

The invention relates to a device for removing at least one cooling element from an at least partially demoulded cast part, in particular from a cast housing for an electric motor formed from a light metal alloy, which has an apparatus for removing the at least one cooling element. The invention further relates to a method for removing at least one cooling element from an at least partially demoulded cast part, a method for introducing at least one cooling element into a mould core of a cast part mould, a cooling element and a cast part.

Description of Related Art

From the prior art, it is known that so-called cooling irons made of grey cast iron or a machining steel are introduced into a cast part mould. As a result, an improvement in mechanical properties and a reduction in porosity in the cast part are achieved in particular during solidification in an effective region of the cooling iron. After an at least partial demoulding, in particular a partial de-sanding, the cooling irons adhering to the cast part can be manually removed or removed and reused.

SUMMARY OF THE INVENTION

The object underlying the present invention is to create a device of the type mentioned above which enables an automated removal of the at least one cooling element.

According to the invention, this object is achieved in that the removal apparatus comprises a means for gripping a removal protrusion attached to the at least one cooling element. The removal device is preferably designed to be movable in order to remove the at least one cooling element from a cast part arranged so as to be stationary. It is also conceivable that a removal device is arranged so as to be stationary and a cast part for cooling element removal is moved relative to a removal apparatus. Manual removal of the cooling elements is advantageously not necessary. Furthermore, centring can advantageously be achieved by the removal apparatus, which enables a consistently identical positioning of the at least one removed cooling element. This enables automated placement in a storage pallet for reuse.

In particular, in the manufacture of cast parts which are formed from a light metal alloy, preferably from an aluminium or magnesium alloy and are provided as housing for an electric motor, special properties such as low porosity and/or high strength are required in regions which serve to receive a stator or a stator carrier. In order to enable a compact housing and reliable cooling during engine operation, the housing must have a particularly low porosity, especially in the region of cooling channels, in order to avoid coolant loss. In order to meet these requirements, it is necessary to introduce at least one cooling element into a mould core, which can for example be a sand or a salt core, into a cast part mould with which a cast part is manufactured. The cast part mould can be a permanent mould such as a die or a sand mould intended for single use.

The removal protrusion is formed integrally on the cooling element, is materially bonded to it or can be detachably connected to the cooling element. A particularly easy replacement of a removal protrusion is advantageously possible through a detachable connection. Required maintenance and/or repair work is reduced. The cooling element is preferably formed from grey cast iron or a steel, in particular a machining steel.

It is also conceivable that a cooling element has a plurality of removal protrusions. If one of the removal protrusions is damaged, another can be advantageously used to remove the cooling element from the cast part. Immediate replacement is not necessary.

A one-piece moulding advantageously enables simple manufacture, while a materially bonded connection enables a damaged removal protrusion to be replaced or repaired by welding and soldering.

Expediently, the gripping means comprises at least one pair of rails spaced apart from one another, which are configured to engage behind the removal protrusion. Advantageously, the removal protrusion can be gripped by a pair of rails in such manner that only removal forces are transmitted which preferably act perpendicular or almost perpendicular to a longitudinal direction of the rails. A transmission of transverse forces or bending moments, for example, which could cause damage to the protrusion or the rails, is advantageously avoided.

In one configuration of the invention, the removal protrusion of the at least one cooling element comprises at least one pair of rails spaced apart from one another, which are configured to be gripped by the gripping means. Advantageously, the removal apparatus is simplified in terms of design and thus enables longer downtimes.

In one configuration of the invention, the gripping means has a plurality of rail pairs, which are arranged next to one another in the circumferential direction of a substantially rotationally-symmetrical, preferably cylindrical or truncated cone-shaped removal head and extend in particular parallel or obliquely to longitudinal axis thereof. Advantageously, a plurality of cooling elements can be removed simultaneously in a single work step and centred by the removal head when they are removed. The cooling elements are introduced into a substantially rotationally-symmetrical, preferably cylindrical or truncated cone-shaped mould core of a cast part mould, which represents a hollow space for receiving the rotor or a rotor carrier of the electric motor.

If a plurality of cooling elements are provided, which preferably form flush surface sections of a mould core and are in contact with a melt during filling of a cast part mould, each has a surface whose outer contour is almost identical to a functional inner contour section of a hollow space of a cast part, from which the cooling element can be removed. Advantageously, a cast part can be manufactured close to the end contour.

A particularly good fixing of the cooling elements in the mould core as well as their particularly good gripping ability during removal from the cast part is achieved if a removal protrusion is arranged on one side of a cooling element facing away from one side, which is in contact with the melt when filling the cast part mould. As a result, the removal protrusion can, on the one hand, form a latching connection with the mould core and can also be gripped by the gripping means.

A mould core particularly suitable for the method according to the invention can be formed in one or more parts, in particular in two parts. Advantageously, there is a particularly high degree of design freedom.

In order for the at least one cooling element to be introduced into the mould core in such manner that a plurality of surface sections are formed, of which at least one is formed by an outer side of the cooling element, it can be laid into a mould core manufacturing tool before forming sand is introduced. A stationary arrangement in the mould core manufacturing tool can be effected by the removal protrusion, which engages into a holding apparatus in the tool for this purpose. This ensures the stationary arrangement even when the forming sand is fired into the tool under pressure. The removal protrusion advantageously acts for fixing in the mould core manufacturing tool and as a counterholder to a gripping means of an apparatus for removing at least one cooling element from an at least partially de-sanded cast part.

Due to the arrangement of the rails parallel or oblique to the longitudinal axis of the substantially rotationally-symmetrical removal head, each pair of rails can engage behind an associated removal protrusion in the case of a straight movement of the removal head into the hollow space. Advantageously, several cooling elements can be removed in one work step. The cooling elements are also advantageously centred when they are removed. This makes it possible, in particular, to automatically insert them into a cooling iron storage pallet and to re-feed them into the core manufacturing process. A fully automated manufacturing process without manual intervention is possible.

In a configuration of the invention, each of the rails can be detachably connectable to a rotationally-symmetrical, preferably cylindrical or truncated cone-shaped removal head of the removal apparatus or to the at least one cooling element. Advantageously, damaged rails can be easily replaced. Maintenance and/or repair work is reduced.

In a further configuration of the invention, a diameter of a substantially truncated cone-shaped removal head of the removal apparatus increases in a direction in which the removal head can be moved into a cast part hollow space for removal of cooling elements and which is preferably coaxial to a longitudinal direction of the removal head. This enlargement causes the formation of a demoulding incline, which ensures that the forces required to remove cooling elements from a cast part are applied in a linearly increasing manner. Tension peaks that could damage the removal head are advantageously avoided.

In order that tension peaks can be further reduced, a removal protrusion of a cooling element has a T-shaped cross-section and preferably extends in a longitudinal direction of the cooling iron. T-bars can advantageously be gripped or engaged behind by the gripping means, in particular by a pair of rails, in such manner that no transverse forces or bending moments occur which can cause damage to the removal protrusion.

If a thickness of the T-bars increases from a first end to a second end, in particular in the longitudinal direction of a cooling element, preferably linearly, a linear movement of a removal head or such movement of the cast part relative to a stationary removal head can be converted into a movement of the cooling elements with a movement component perpendicular to the movement direction of the removal head, with a gripping means, which has a rail pair for engaging behind the T-bars. Advantageously, a detachment of cooling elements from the cast part is effected. Further advantageously, a linear movement of the cast part or the removal head can be converted into a differently orientated movement of the at least one cooling element. The rails, which are preferably flat and have a constant thickness, slide along the T-bars.

If the removal head also has a demoulding incline, for example between 2 and 5 degrees, preferably 4 degrees, a particularly short path is required in combination with T-bars with varying thickness during a removal movement in order to apply a sufficiently high force to release the at least one cooling element from the cast part, to centre it and finally to take it along for removal from a cast part hollow space.

By using at least one cooling element, a cast part wall section is formed in a cast part, which in the case of cast part manufacture abuts with one side against the at least one cooling element and which has a secondary dendritic arm distance between 3 and 30 μm, preferably between 15 and 25 μm. Advantageously, a particularly high strength with simultaneously low porosity is achieved. A low porosity is in particular necessary if the cast part wall section delimits a cooling channel in which a liquid cooling medium is guided during engine operation.

If a cast part comprises a groove which is provided for receiving a sealing ring, pores have a Feret diameter of max. 0.9 mm, preferably between 0.5 and 0.8 mm. A particularly dense cast part can be advantageously manufactured. Coolant losses during engine operation are prevented.

BRIEF DESCRIPTION OF THE DRAWINGS

The invention is explained in more detail below on the basis of exemplary embodiments and the enclosed drawings relating to the exemplary embodiments. In the drawings is shown.

DESCRIPTION OF THE INVENTION

Figure 1A:
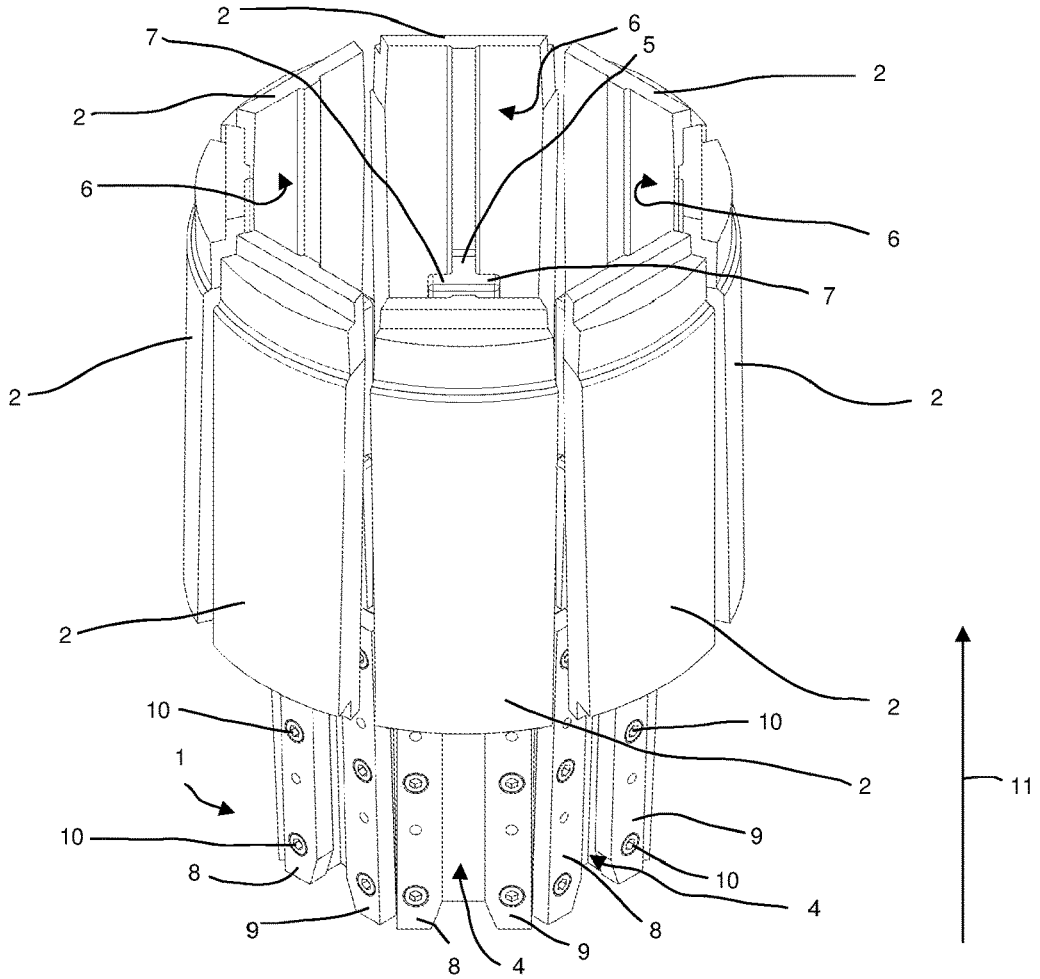
FIGS. 1*a-e* a removal device according to the invention in a plurality of views, FIGS. 2*a-b* a cooling element according to the invention in different views, FIGS. 3*a-b* a removal device according to the invention when removing cooling elements from a cast part, FIGS. 4*a-c* a two-part mould core provided with cooling elements according to the invention, FIGS. 5*a-c* a one-part mould core provided with cooling elements according to the invention and an associated mould core manufacturing tool.
Figure 1B:
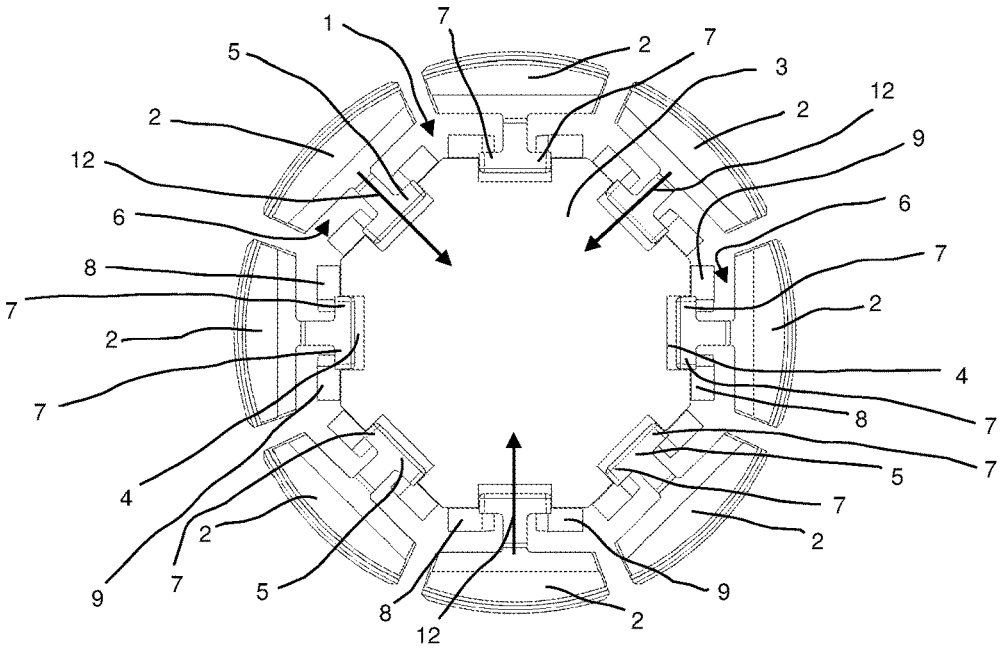
Figure 1C:
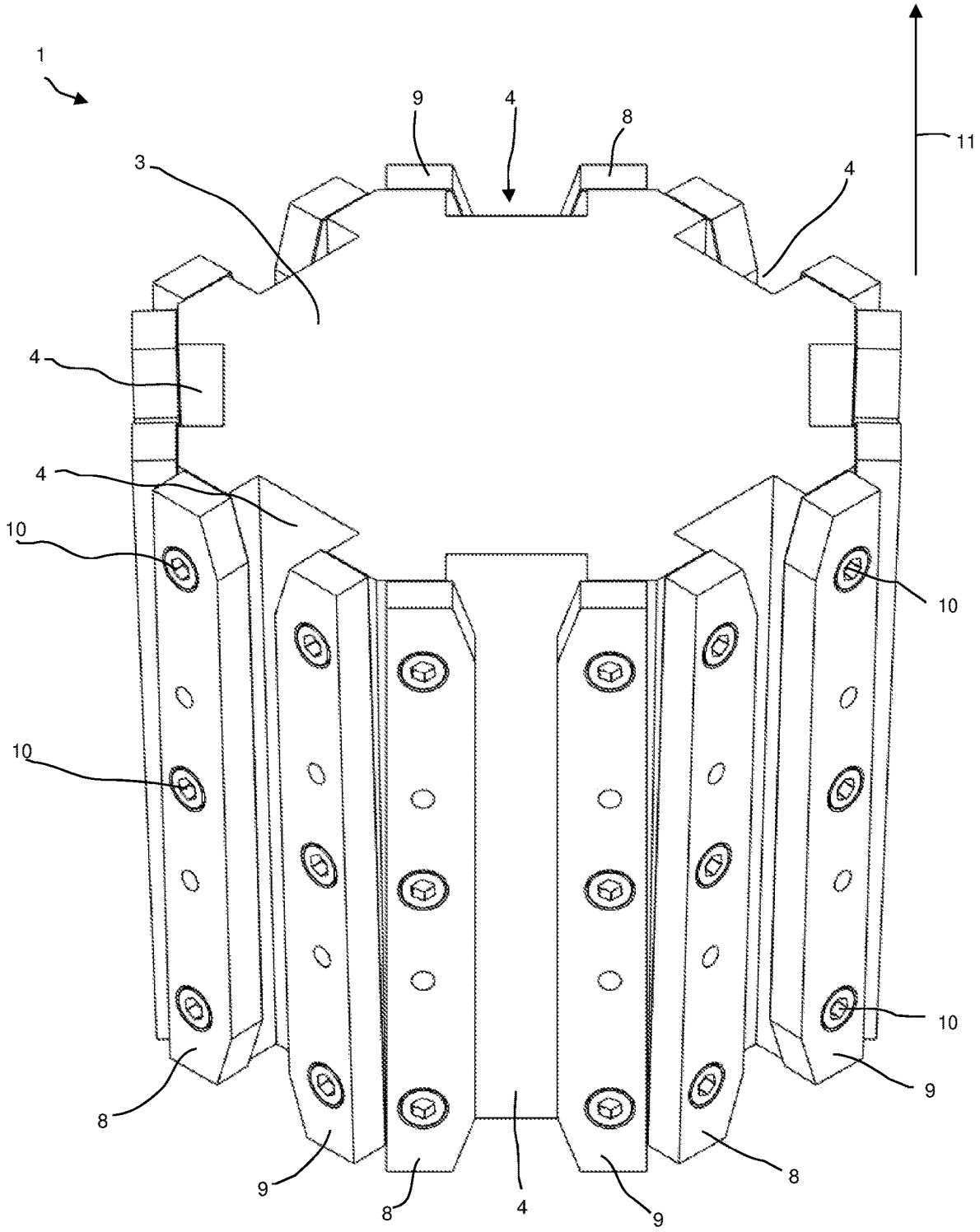
Figure 1D:
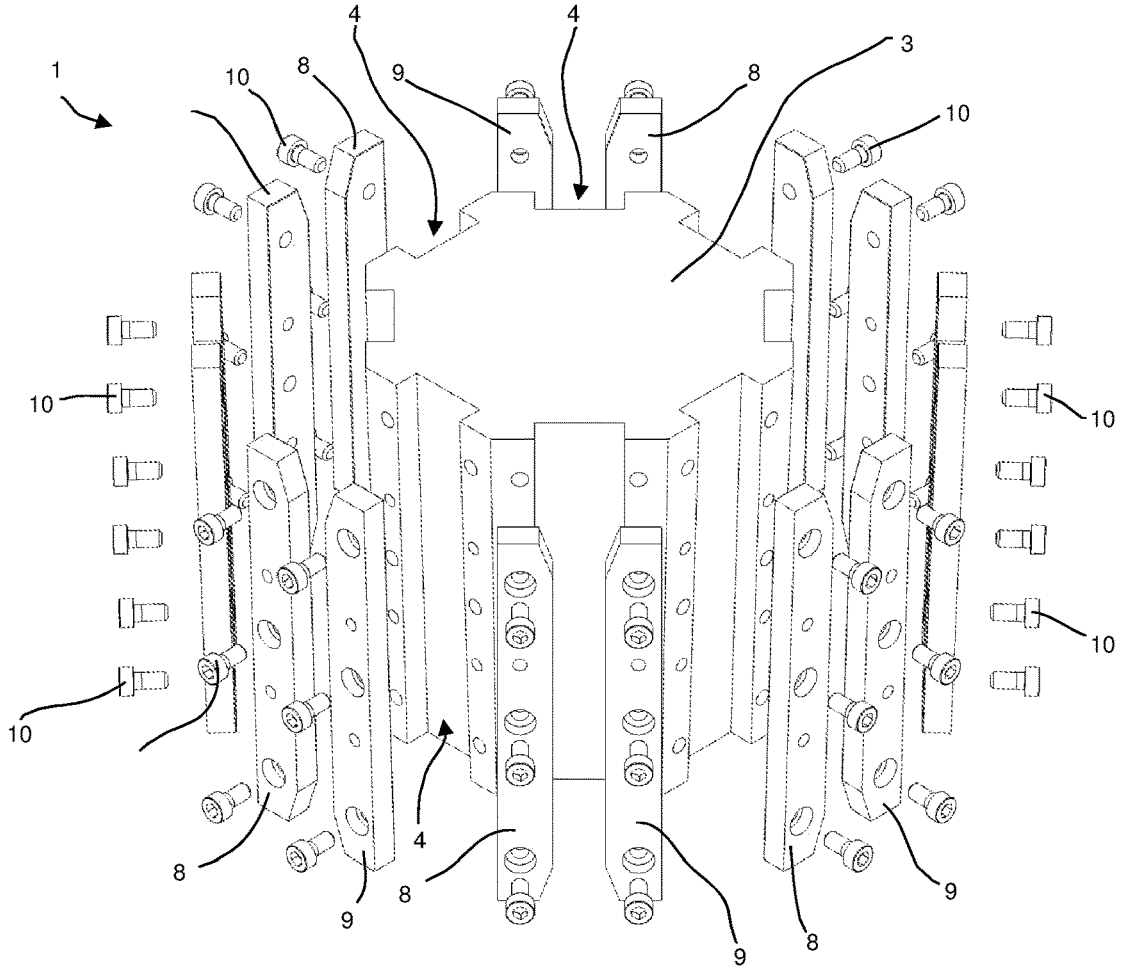
Figure 1E:
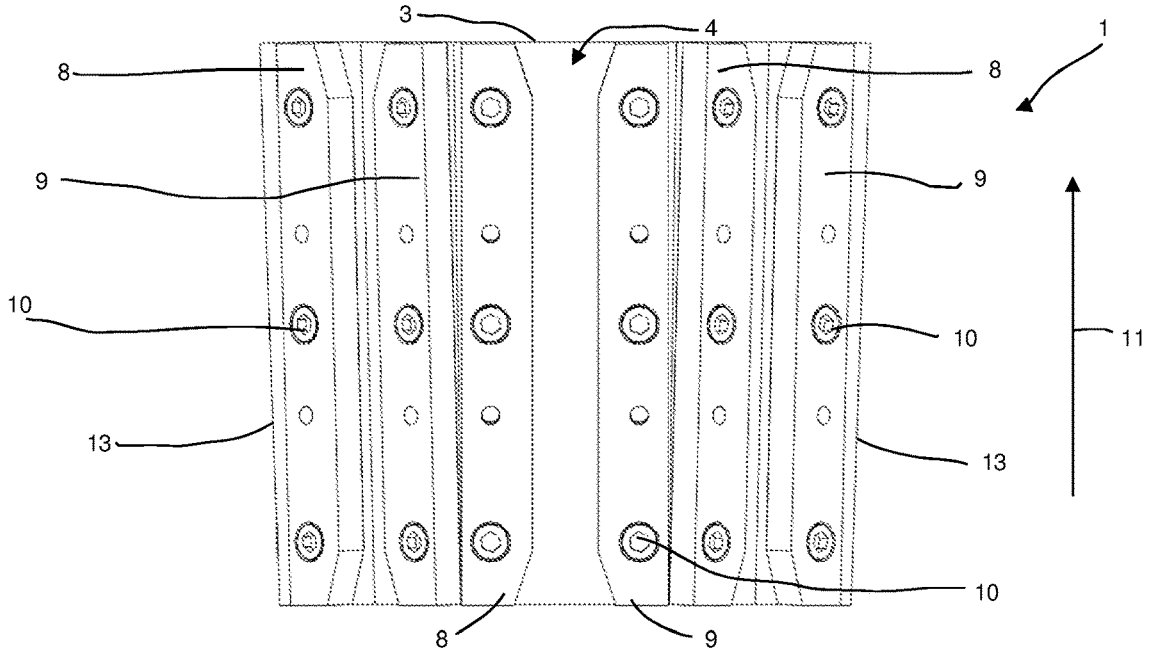

An apparatus (1) shown in FIG. 1*a* in a perspective view for removal of eight identical metallic cooling irons (2) arranged next to one another in a circular manner from a cast part not shown in FIG. 1*a* comprises a substantially truncated cone-shaped removal head (3) shown in detail in FIG. 1*c-e*, into which eight longitudinal grooves (4) shown in FIGS. 1*a+b* are inserted, into which is guided a removal protrusion (5) formed integrally on the cooling iron (2) and in a T-shape in the cross-section, which protrudes from one side (6) of the cooling irons (2) facing the removal apparatus (1).

The removal apparatus (1) comprises rails (8, 9) extending in the longitudinal direction of the removal head (3) and formed from a hardened steel, with constant thickness, which are arranged next to one another in pairs in the circumferential direction and are detachably connected to the removal head (3) by a plurality of screws (10). It is also conceivable that the rails (8, 9) have a varying thickness in their longitudinal direction.

The rails (8, 9) are tapered at both ends and are provided for engaging behind T-bars (7) of the removal protrusions (5) when removing the cooling irons (2) from the cast part, as shown in FIG. 1*b* in a top view from two opposing sides.

To remove the cooling irons (2), the removal head (3) of the removal apparatus (1) is moved in the direction of an arrow (11) shown in FIG. 1*a* parallel to its longitudinal axis into the cast part, whereby a movement of the cooling iron (2) takes place in the direction of arrows (12) shown in FIG. 1*b* by way of example. As a result, the cooling irons (2) are removed from a cast part shown in FIGS. 3*a-b*, centered and can be removed in the same step.

A removal apparatus (1) is shown in detail in FIG. 1*c* in a perspective view and in FIG. 1*d* in an exploded view.

In the case of a substantially truncated cone-shaped removal apparatus (1) shown in FIG. 1*e* in a side view, a surface line (13) inclined by 4 degrees relative to the cone axis is clearly recognisable. This forms a demoulding incline.

Figure 2A:
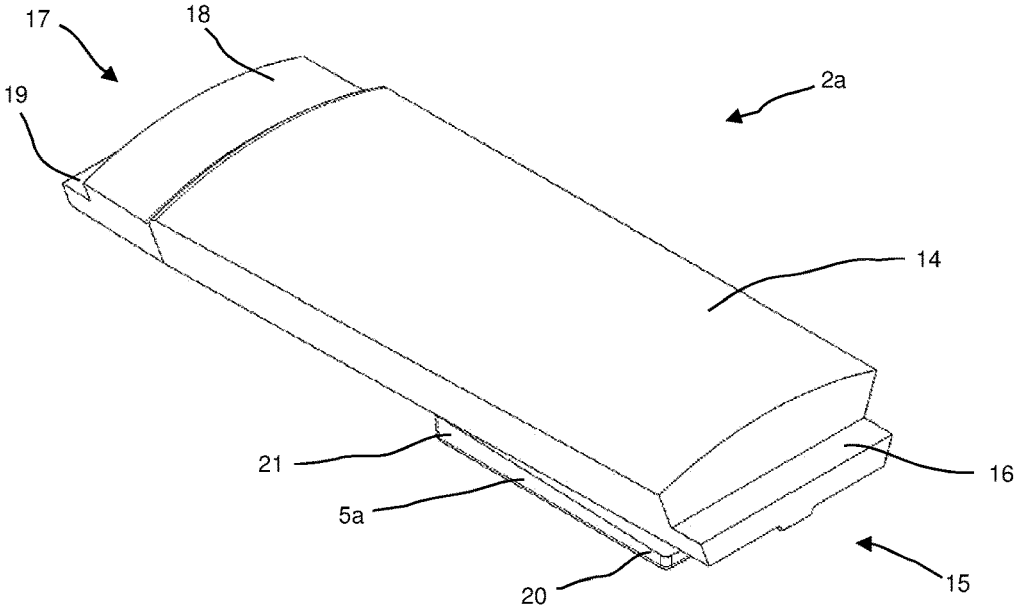
Figure 2B:
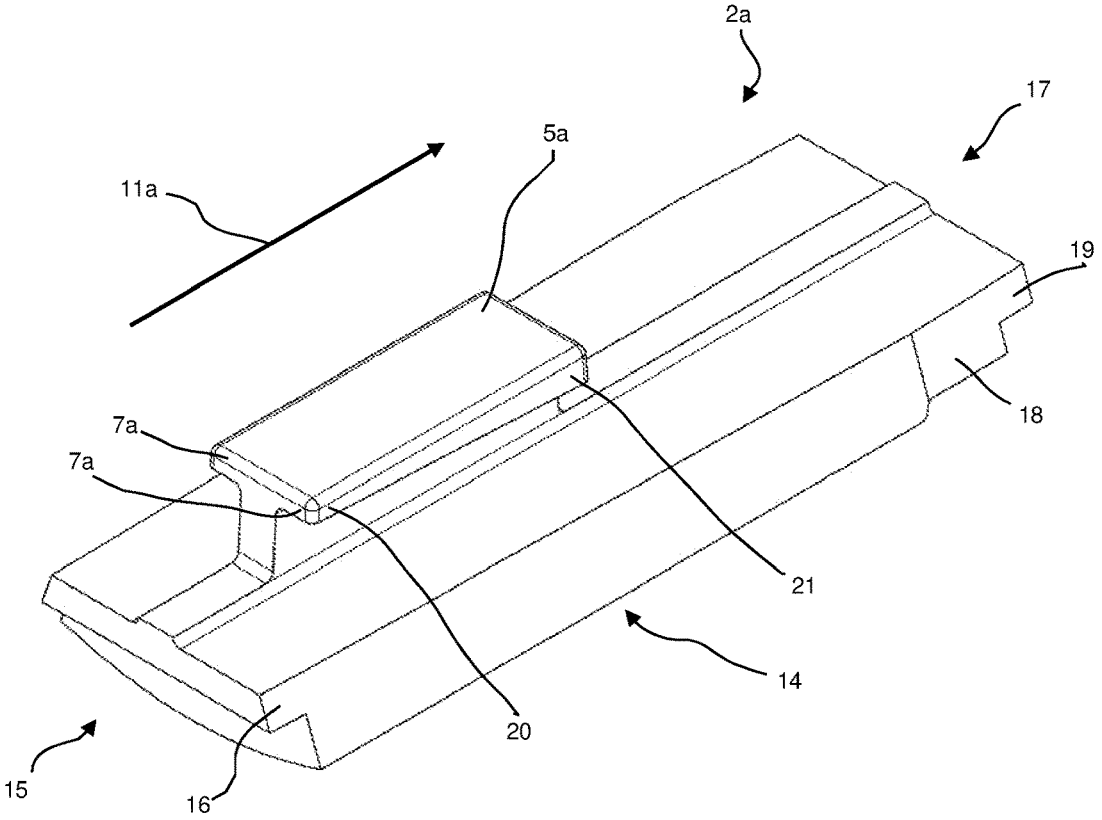

Reference is now made to FIGS. 2*a-b* where the same or identical parts are designated with the same reference numeral as in FIGS. 1*a-e* and in each case the letter a is added to the reference numeral in question.

Figure 3A:
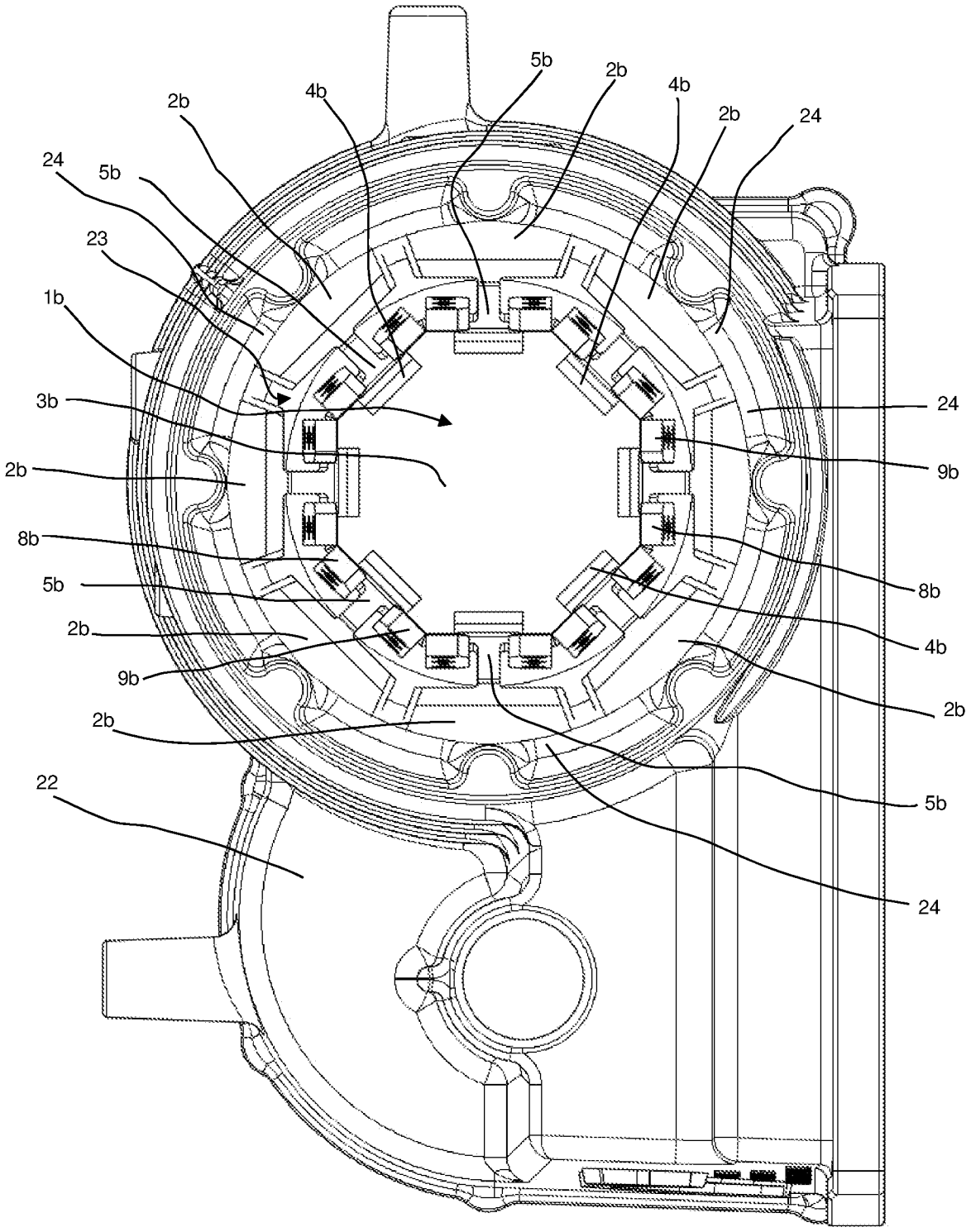
Figure 3B:
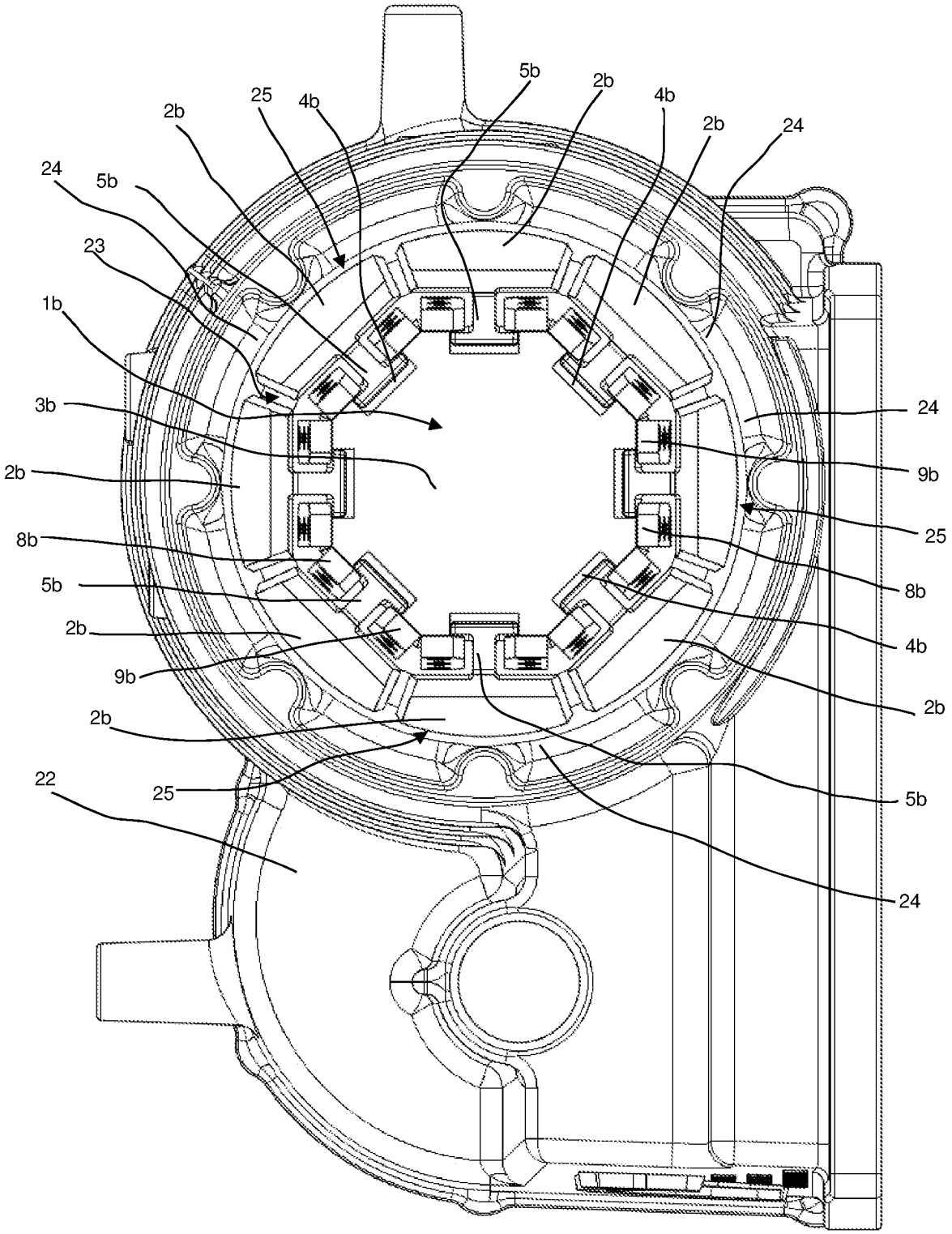

A cooling iron (2*a*) shown in FIG. 2*a* in a perspective top view of an outer side has a bent surface (14), whose outer contour is almost identical to a functional inner contour section of a hollow space of a cast part (22) designated in FIGS. 3*a-b* with (23) from which a cooling element (2*a*) can be removed. The surface (14) is further provided to come into contact with a metal melt with which a cast part mould is filled. This results in a particularly good cast part quality, in particular high strength and low porosity in a cast part region adjacent to the cooling iron (2*a*). This can, for example, extend up to 25 mm from the cooling iron (2*a*) and have a porosity with pores with a Feret diameter of max. 0.8 mm.

A first protrusion (16) is integrally formed on a first end face (15), while two further protrusions (18, 19) are formed on a second end face (17). The protrusions (16, 19) are provided to be engaged behind by a mould core into which the cooling iron (2*b*) is introduced. This achieves both a fixing in the mould core and a flush ending of a surface of the mould core with the bent surface (14) of the cooling iron (2*a*).

A cooling iron (2*a*) shown in FIG. 2*b* in a perspective view of an inner side has a first surface (14) and a second surface (14*a*), where the first surface (14) is opposite the second surface, and the first surface (14) is in contact with the light metal melt when the mould is filled. The cooling iron (2*a*) comprises a removal protrusion (5*a*), which has a T-shaped cross-section and extends in the longitudinal direction (11) of the cooling iron (2*a*). The T-shaped removal protrusion (5*a*) has a shaft extending radially from the second surface and T-bars (7*a*) attached to and extending perpendicularly from an outermost end of the shaft. A thickness of T-bars (7*a*) in a radial direction (12) increases linearly from a first end (20) of the removal protrusion (5*a*) to a second end (21) of the removal protrusion (5*a*). This creates an oblique plane along which slide rails shown in FIGS. 1*a-e* and designated with (8, 9) during an insertion movement of a removal apparatus not shown in FIGS. 2*a-b* in the direction of an arrow (11*a*). This causes a linear movement of the removal apparatus into a movement of the cooling irons (2*a*) with a radial direction component away from the cast part in the direction of arrows designated in FIG. 1*b* with (12).

Reference is now made to FIGS. 3*a-b*, where the same or identical parts are designated with the same reference numeral as in FIGS. 1*a-e* and 2*a-b* and in each case the letter b is added to the reference numeral in question.

A housing (22) for an electric motor shown in FIG. 3*a* in top view and formed from an aluminium alloy comprises a substantially truncated cone-shaped hollow space (23) with a surface line inclined by 1 degree relative to the cone axis, which is provided to receive a stator or a stator carrier of the electric motor not shown in FIGS. 3*a-b*.

A removal apparatus (1*b*) for cooling irons (2*b*) is introduced into the hollow space (23), whose rails (8*b*, 9*b*) engage behind T-shaped removal protrusions (5*b*) of the cooling irons (2*b*) and which in FIG. 3*a* is in an initial position in which no removal forces act on the cooling irons (2*b*). Each cooling iron (2*a*) abuts and adheres with a surface designated in FIGS. 2*a* and *b* with (14) against an associated cast part wall section (24).

During a linear movement of the removal apparatus (1*b*) into the hollow space (23), the rails (8*b*, 9*b*) slide along a steep plane of the removal protrusions (5*d*) shown in FIGS. 2*a-b*, whereby a movement of the cooling irons (2*b*) away from the cast part wall section (24), against which they abut and adhere, is caused with a movement component in a radial direction of the hollow space (23). The cooling irons (2*b*) are separated from the cast part (22) in an end position shown in FIG. 3*b*. A gap (25) is formed between the cooling irons (2*b*) and the associated cast part wall section (24). In this position, the cooling irons (2*b*) are held by the removal apparatus (1*b*) and can also be taken out of the hollow space (23) by way of a movement direction opposed to an insertion direction.

The regular arrangement of the rails (8*b*, 9*b*) and the movement of the removal apparatus (1*b*) into an end position further causes a centring of the cooling irons (2*b*), whereby an automated insertion is made possible into a cooling iron storage pallet not shown in FIGS. 3*a-b*.

It is also conceivable that the removal apparatus (1*b*) is inserted into the hollow space on a first side and exits the hollow space (23) on a side facing away from the first side and also takes the cooling irons (2*b*) with it. Advantageously, this prevents individual cooling irons (2*b*) becoming stuck when moving out in a movement direction opposed to the insertion direction and causing a standstill in an automated removal process.

Figure 4A:
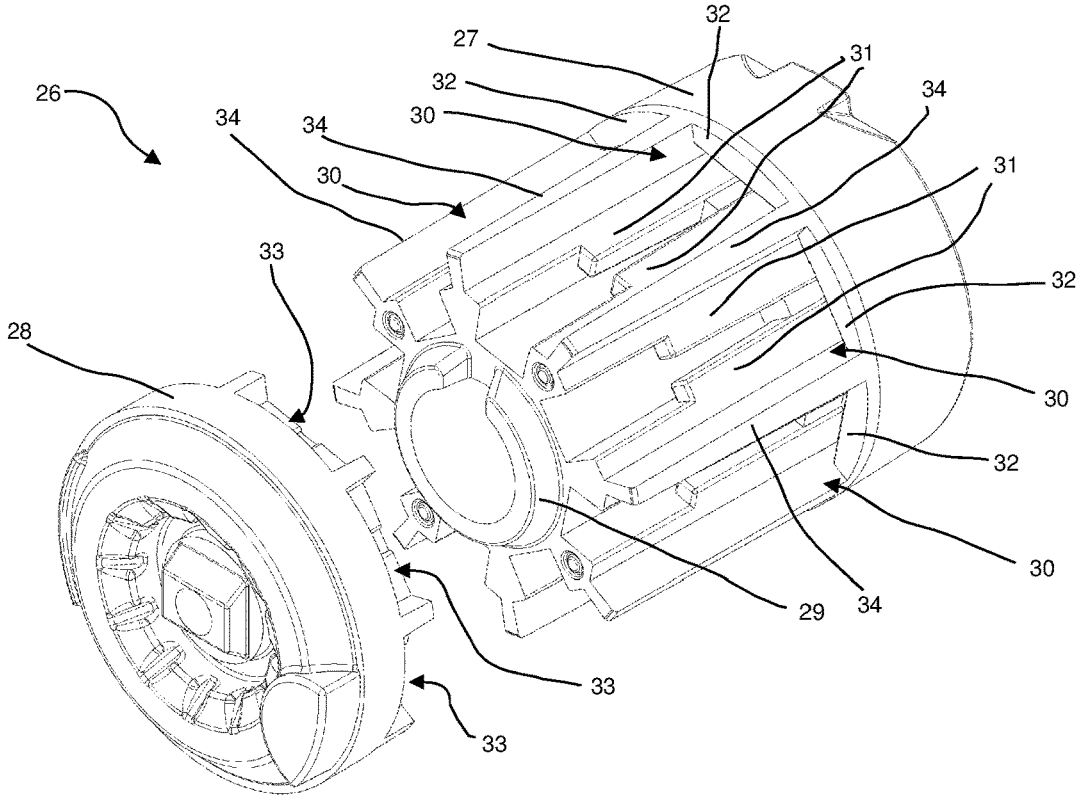
Figure 4B:
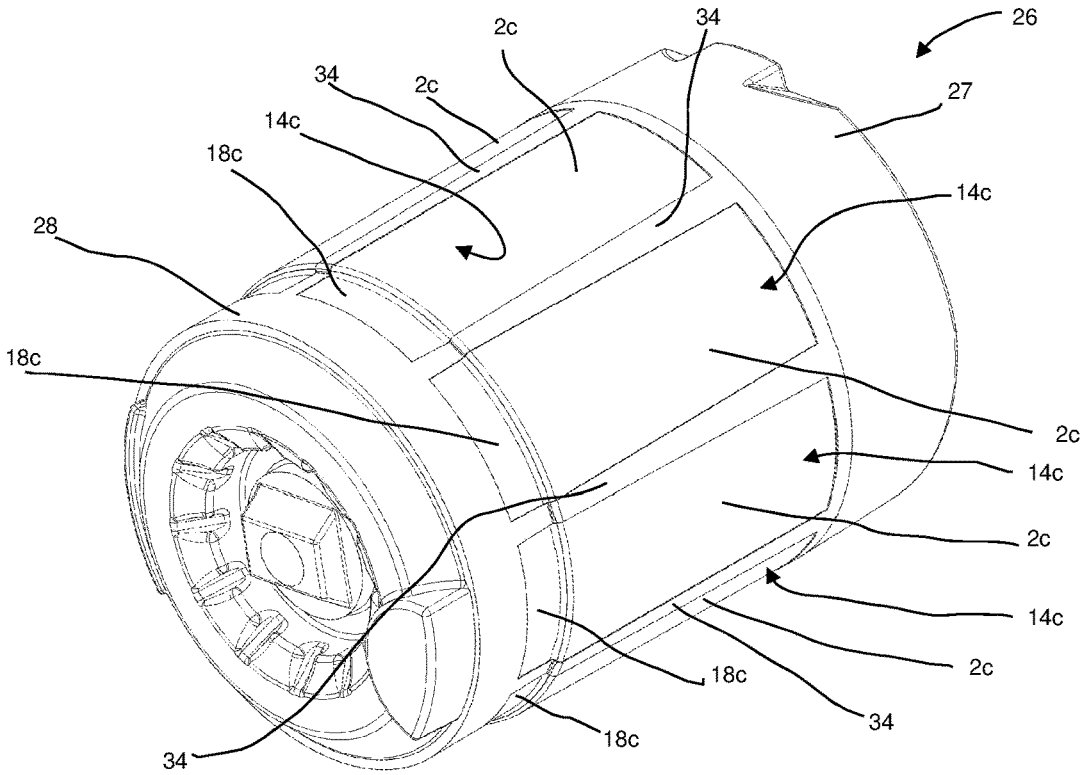
Figure 4C:
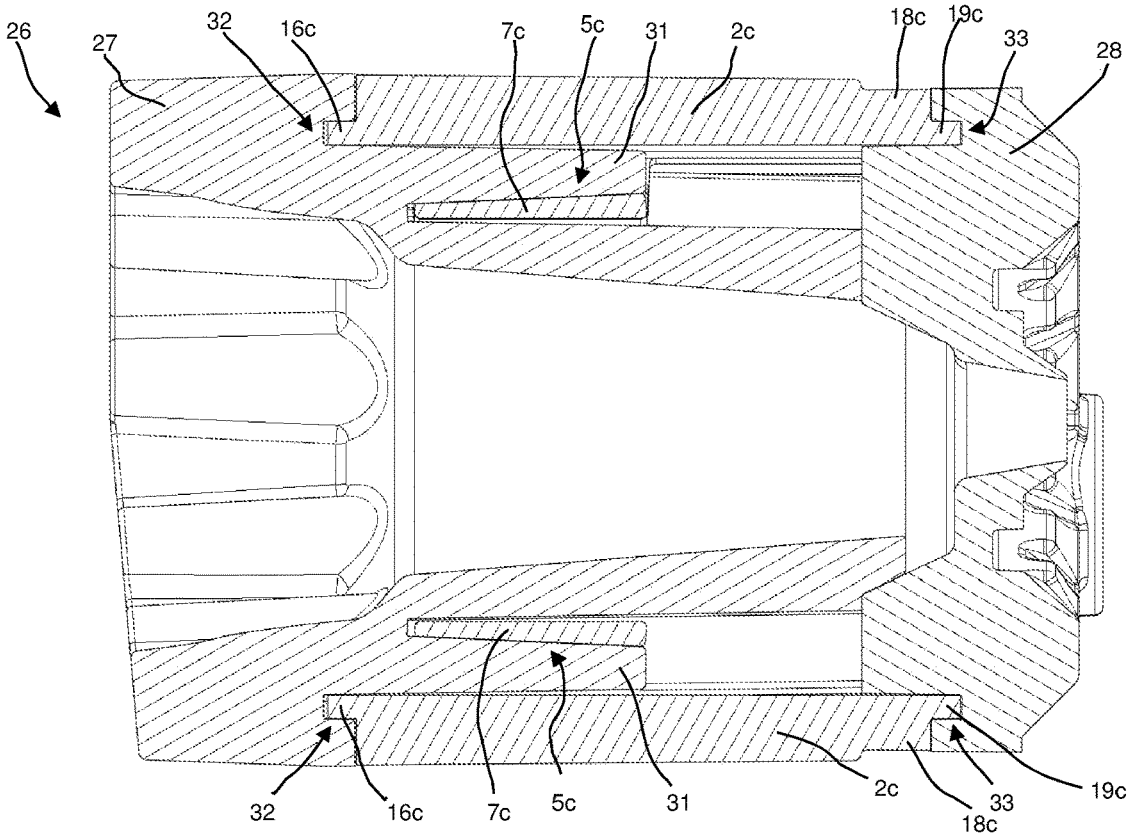

Reference is now made to FIGS. 4*a-c*, where the same or identical parts are designated with the same reference numeral as in FIGS. 1*a-e* to 3*a-b* and in each case the letter c is added to the reference numeral in question.

A two-part truncated cone-shaped sand core (26) shown in FIG. 4*a* in an exploded view and formed from a forming sand has two sand core parts (27, 28) that are connectable to one another by means of a push-in and adhesive connection, by means of which a ring-like protrusion (29) of a first mould core part (27) is inserted into a groove, which is not shown in FIGS. 4*a-c* and has an adhesive.

A plurality of material recesses (30) are configured to receive cooling irons (2*c*) in the sand core (26), with T-bars (7*c*) of a removal protrusion (5*c*) being gripped by two sand bars (31). While a protrusion (16*c*) of the cooling iron (2*c*)

shown in FIG. 4*c* is provided to be inserted into a pocket (32) in the sand core part (27), a further protrusion (19*c*) engages into a pocket (33) in the sand core part (28).

A total of eight cooling irons (2*c*) are introduced into an assembled sand core (26) shown in FIG. 4*b* in a perspective view. Surfaces of sand bars (34) are flush with cooling iron surfaces (14*c*) and form a flat overall surface which is provided to be in contact with a metal melt, with which the cast part mould is filled, when filling a cast part mould. A cast part produced with such a core is manufactured close to the end contour.

In the case of an assembled two-part sand core (26) shown in the longitudinal section in FIG. 4*c*, sand bars (31) of a sand core part (27) engage behind T-bars (7*c*) of retaining protrusions (5*c*).

Figure 5A:
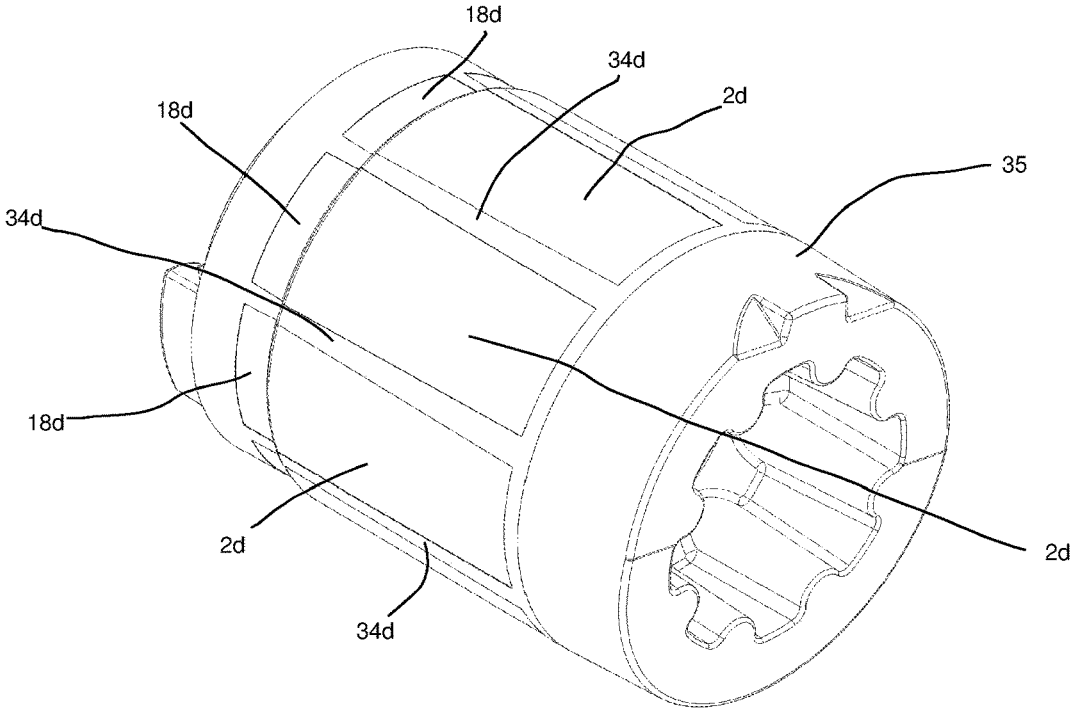
Figure 5B:
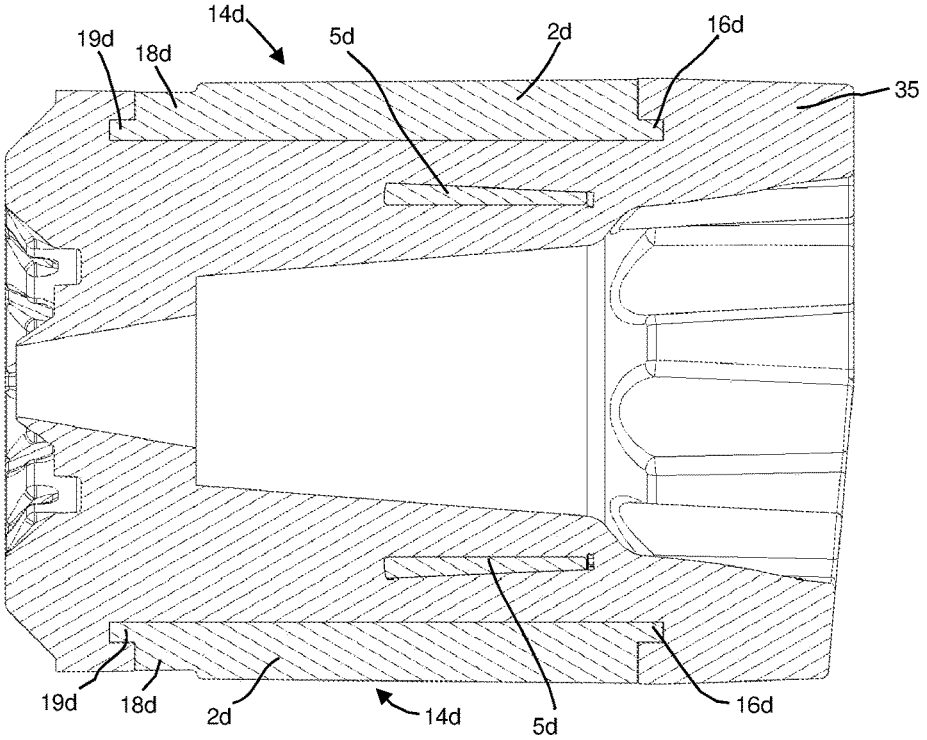
Figure 5C:
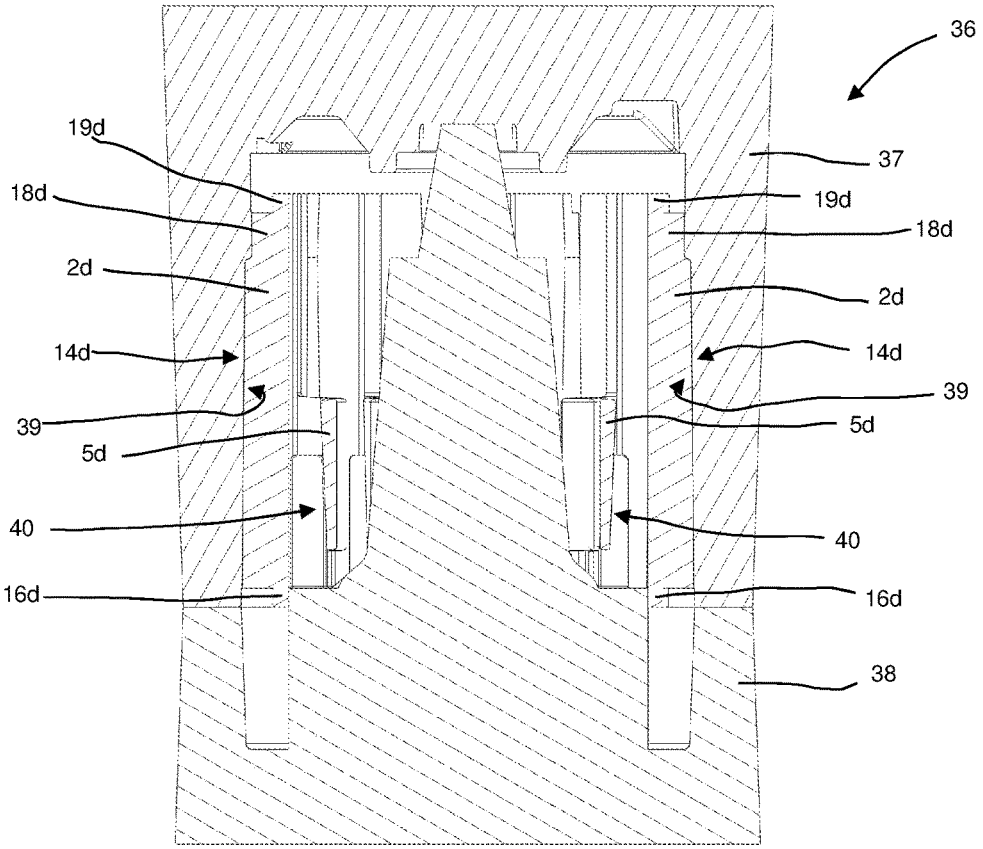

Reference is now made to FIGS. 5*a-c* where the same or identical parts are designated with the same reference numeral as in FIGS. 1*a-e* to 4*a-c* and in each case the letter d is added to the reference numeral in question.

A sand core (35) shown in FIG. 5*a* in a perspective view and in FIG. 5*b* in a partially sectioned side view is formed integrally. Cooling irons (2*d*) are introduced, for the manufacture thereof, into a mould core manufacturing tool (36) shown in FIG. 5*c* in a sectioned side view and fired during a core manufacture, i.e. flowed around with curable forming sand until the mould filling is complete.

The mould core manufacturing tool (36) comprises an upper part (37) and a lower part (38) which enclose a space into which forming sand and cooling irons (2*d*) can be introduced for the core manufacture and which can be moved relative to one another in order to be able to remove a manufactured mould core.

An upper side (14*d*) of the cooling irons (2*d*) abuts against a mould wall surface (39).

Furthermore, retaining recesses (40) are provided in which the retaining protrusions (5*d*) of the cooling irons (2*d*) engage, whereby a stationary arrangement is ensured in the mould core manufacturing tool (36).

Although in the exemplary embodiments, a removal apparatus (1; 1*b*) with a movable removal head (3; 3*b*) was shown for removal of cooling elements (2-2*d*) from a cast part (22), which is arranged so as to be stationary, it is conceivable that the removal head (3; 3*b*) is arranged so as to be stationary and the cast part (22) is movable for removal of the cooling elements.

The invention claimed is:

1. A cooling element for a cast part mould for manufacturing a cast part formed from a light metal alloy, wherein the cooling element is introduced into a mould core of the cast part mould before filling the cast part mould with a light metal alloy melt, is in contact with the light metal alloy melt during filling, and acts to cool the light metal alloy melt filled within the cast part mould, the cooling element comprising:

a body having a first surface and a second surface, the first surface opposite the second surface, the first surface being in contact with the light metal melt when the cast part mould is filled; and a removal protrusion protruding from the second surface and configured to be gripped by a gripping mechanism of a removal apparatus when removing the cooling element from an at least partially demoulded cast part, wherein the removal protrusion has a T-shaped cross-section with a shaft extending radially from the second surface and T-bars attached to and extending perpendicularly from an outermost end of the shaft.

2. The cooling element according to claim 1, wherein the removal protrusion extends longitudinally from a first end to a second end and a thickness of the T-bars in the radial direction increases from the first end to the second end.

3. The cooling element according to claim 1, wherein the removal protrusion is formed in one piece, and is connected in a materially bonded manner to the cooling element or detachably connectable to the cooling element.

4. The cooling element according to claim 1, wherein an outer contour of the first surface is substantially identical to a functional inner contour section of a hollow space of the cast part from which the cooling element is removable.

5. The cooling element of claim 1, wherein the removal element extends in a longitudinal direction of the cooling element.

6. The cooling element of claim 1, wherein the removal element is in the form of a rail.

7. The cooling element according to claim 2, wherein the thickness of the T-bars in the radial direction increases linearly from the first end to the second end.

8. A device for removing at least one cooling element according to claim 1 from an at least partially demoulded cast part, the device comprising a removal apparatus comprising a gripping mechanism that engages a removal protrusion attached to the at least one cooling element.

9. The device according to claim 8, wherein the gripping mechanism comprises at least one pair of rails spaced apart from one another, which are configured to engage behind the removal protrusion.

10. The device according to claim 8, wherein the gripping mechanism has a plurality of rail pairs, which are arranged next to one another in a circumferential direction of a substantially rotationally symmetrical removal head and extend parallel or obliquely to a longitudinal axis thereof.

11. The device according to claim 9, wherein each of the rail pairs is detachably connectable to a substantially rotationally symmetrical removal head of the removal apparatus or to the at least one cooling element.

12. The device according to claim 8, wherein a diameter of a substantially truncated cone-shaped removal head of the removal apparatus increases in a direction in which the removal head is movable into a casting cavity for removing the at least one cooling element.

13. A method for removing at least one cooling element according to claim 1 from an at least partially demoulded cast part, wherein a removal apparatus is introduced into a substantially rotationally symmetrical hollow space of the cast part, and the removal protrusion attached to the at least one cooling element is gripped by a gripping mechanism of the removal apparatus.

14. The method according to claim 13, wherein the at least one cooling element is removed from the hollow space by movement of the removal apparatus.

15. The method according to claim 13, wherein, through a movement of the removal apparatus into the rotationally symmetrical hollow space, a movement of the at least one cooling element is effected in a direction of the hollow space, which has a radial movement component.

16. A method for introducing at least one cooling element according to claim 1 into a mould core of a cast part mould wherein the at least one cooling element is introduced into the mould core in such manner that a plurality of surface sections are formed, which are provided for contact with the melt when filling the cast part mould, and wherein at least one of the surface sections is formed by the first surface of the at least one cooling element.

17. The method according to claim 16, wherein the at least one cooling element is introduced into the mould core prior to introducing forming sand into the mold core and is held stationary in the mould core while the forming sand is introduced.

18. The method according to claim 16, wherein the at least one cooling element is introduced into a mould core with the second surface from which the removal protrusion extends abutting against a wall of the mould core.

19. The method according to claim 16, wherein the cooling element is introduced into a first part of an at least two-part mould core and a second part of the mould core is connected to the first part in such a way that the at least one cooling element is engaged in a pocket in each mould core part.

* * * * *